US006161561A

United States Patent [19]

Pratt et al.

[11] Patent Number: 6,161,561

[45] Date of Patent: Dec. 19, 2000

[54] METHOD OF SUPPLYING LIQUID

[75] Inventors: Simon Michael Pratt, Longparish, United Kingdom; Jean-Claude Andre Chalmet, Filothei, Greece

[73] Assignee: Aquarius Holdings Limited, Guernsey, United Kingdom

[21] Appl. No.: 09/269,174

[22] PCT Filed: Sep. 26, 1997

[86] PCT No.: PCT/GB97/02658

§ 371 Date: Sep. 3, 1999

§ 102(e) Date: Sep. 3, 1999

[87] PCT Pub. No.: WO98/13558

PCT Pub. Date: Apr. 2, 1998

[30] Foreign Application Priority Data

Sep. 26, 1996 [GB] United Kingdom ..... 9602119

[51] Int. Cl.[7] ..... E03B 11/00

[52] U.S. Cl. ..... 137/1; 137/236.1

[58] Field of Search ..... 137/1, 236.1

[56] References Cited

U.S. PATENT DOCUMENTS 4,335,977 6/1982 Ihli .

4,735,524 4/1988 Dunkers .

4,881,482 11/1989 Sandwith et al. ..... 137/236.1 X 4,934,404 6/1990 DeStefano ..... 137/236.1 X

FOREIGN PATENT DOCUMENTS 31 18 921 12/1982 Germany .

42 22 867 1/1994 Germany .

*Primary Examiner*—Kevin Lee

*Attorney, Agent, or Firm*—Miles & Stockbridge P.C.; John C. Kerins

[57] ABSTRACT

A method of supplying liquid is provided, including the steps of providing, at a first location, a cistern on land for liquid; providing, at a second location, a floating flexible container of liquid; and incrementally conveying liquid from the container to the cistern according to a demand determined according to the use of liquid in the cistern. The invention is directed to an apparatus for supplying liquid employing the on-land cistern and floating flexible container.

18 Claims, 1 Drawing Sheet

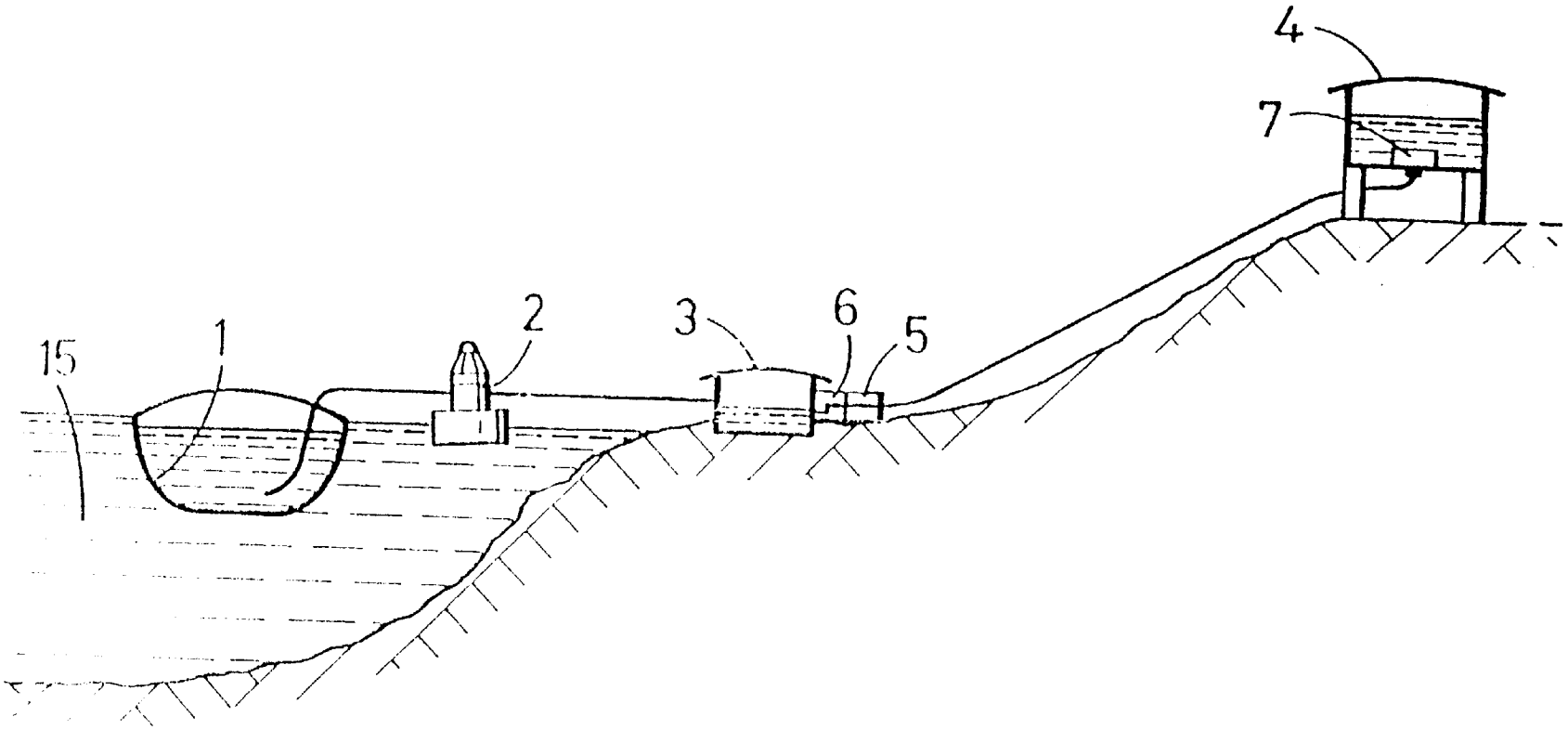
4
7
5
6
3
2
1
15

METHOD OF SUPPLYING LIQUID

The present invention concerns a method of supplying liquid, and in particular to a method of supplying water.

For certain land areas, for example parts of Greece, water is generally scarce and has to be brought into the area from elsewhere. For coastal areas, this is commonly accomplished by shipping in water by tanker. On arrival of the tanker, its hold of water is pumped into a nearby on-shore cistern. In this regard, the timing of the tanker's arrival has to be carefully managed since such on-shore cisterns are generally of a critical size. That is to say, the water in the cistern can not be allowed to run out, since such a shortage or lack of water could be disastrous for the local inhabitants. Furthermore, because of a lack of available on-shore space, such cisterns are generally restricted in size. Thus if the cistern still contains more than a certain amount of water on arrival of the tanker, ten it may not be able take all the tanker's cargo so that when the tanker leaves it has to carry undischarged water with it to its next destination. Since a tanker is most cost effective when transporting goods, it is not commercially expedient to wait for the cistern level to drop to enable complete emptying of the cargo. In addition, the water must be pumped into the cistern quickly since a stationary tanker does not repay the capital investment therein.

Whilst careful management can help to reduce such wastage, fluctuations in demand, for example, because of variable weather conditions, can upset predictions of water requirements. The smaller the on-shore cistern and the greater the lead time of delivery of water, the more difficult such management becomes. For example, a small cistern will run out more quickly and will thus be affected more seriously by demand fluctuations. Also, with long delivery lead times additional consideration has to put into planning for future demand since short notice top-ups on extra demand are not possible.

An object of the present invention is to provide a method of supplying water that seeks to alleviate the problems associated with known arrangements.

According to a first aspect of the present invention, there is provided a method of supplying liquid comprising the steps of:

providing at a first location a cistern on land for liquid;

providing at a second location a floating flexible container of liquid;

incrementally conveying liquid from the container to the cistern according to a demand determined according to the use of liquid in the cistern.

With such a method, a large flexible container of, for example, water can be provided off-shore and connected to a cistern by way of suitable piping. Water can be then be pumped to the cistern when usage of water in the cistern is such that the cistern requires topping up.

The provision of a large flexible container of liquid off-shore is advantageous in that no on-shore space is taken up, hence the size of the container is not restricted.

Such flexible containers are also a small fraction of the cost of conventional tankers and hence represent a comparatively low capital investment.

The use of a container in the sea is furthermore beneficial in warm climates in that the temperature of the sea-water will keep the liquid sacred within the container cool and thus slow down deterioration thereof.

The flexible container in question may be a floating flexible vessel of the sort used for transporting fluent cargo through liquid. Vessels of this nature take the form of closed flexible tubular or envelope structures, generally of a synthetic rubberised fabric. Such vessels are used to transport fluent cargoes having a specific gravity less than that of seawater. When laden the vessel is virtually submerged and buoyancy is supplied by the cargo. To move such laden vessels, they are towed from one end, for example, by a tug boat. Such vessels are much cheaper than conventional tankers.

With the present invention, the use of a floating flexible vessel as a storage means on a semi-permanent basis offers advantages in that such a vessel can be towed to the required location and left there until ultimately it is emptied as the contents thereof are gradually used up. The tug boat that towed the vessel to its location has a relatively quick turn around time as compared with a tanker in that no pumping out of liquid is required. The vessel can merely be uncoupled from the tug and suitably anchored or moored, whereupon the tug can leave to complete a further task.

Preferably, the method further comprises the step of replacing a substantially empty container with a laden container. The tug may thus operate to replace a laden vessel for an empty vessel so that its return journey is not wasted.

In preferred embodiments, the method further comprises pumping liquid from the flexible container to the cistern using a pumping means provided on a movable buoy. In this respect, it is relatively difficult and thus expensive to suck liquid from a container over long distances. It is however relatively easy and hence cheap to drive or push liquid away from the same pump. Thus a pump that may be expensive to run in sucking liquid over a distance of 8 meters may be relatively cheap to run in pushing liquid a distance of over 2 kilometers. Hence, where the container is anchored more than a certain critical distance from shore, pumping the liquid using a pump on a movable buoy that can be brought close to the container can be highly effective.

According to a second aspect of the present invention there is provided apparatus for supplying liquid, such an on land cistern for holding liquid and located at a first location;

a floating flexible container for holding liquid and located at a second location;

means for conveying liquid from the container to the cistern; and control means for determining the extent of use of liquid in the cistern and varying the quantity of liquid supplied to the cistern from the container in increments according to a demand determined by the extent of said use of liquid.

With such apparatus, one can operate the method as defined above and benefit from the advantages thereof.

Preferably, the flexible container is a floating flexible vessel of the sort used for transporting fluent cargo through liquid. The use of a floating flexible vessel offers certain advantages as discussed above.

In preferred embodiments, the apparatus further comprises a pumping means for pumping liquid from the flexible container to the cistern, the pumping means being provided on a movable buoy. The movable pumping means can be brought close to the flexible container so as to facilitate the conveyance of liquid to the cistern.

Conveniently, one or more additional flexible containers can be removably coupled with the flexible container to increase the capacity of the apparatus for periods of increased demand, for example during the summer period.

The cistern may be a buffer cistern for covering change overs of flexible containers, the liquid being supplied direct therefrom to a mains supply pump. Alternatively, the cistern is preferably a first cistern that supplies a remotely located second cistern. The second cistern is in this respect usually provided at an elevated position from the first cistern so as to provide the head required for a pressurized water system.

An example of the present invention will now be described by way of reference to the accompanying drawing which shows a floating flexible container 1 in a harbour 15 coupled via a pump 2 on a movable floating buoy to a first on-shore cistern 3.

The pump 2 on the movable buoy may be used if the container is positioned more than a certain critical distance from the cistern, since sucking liquid for distances greater than this is expensive. If however the container can be moored sufficiently close to the first cistern 3, then the pump 2 may be provided at the first cistern itself.

The first cistern 3 is shown supplying a remotely located second cistern 4 using pump 5. The second cistern is in this respect provided at an elevated position from the first cistern so as to provide the head required for a pressurized water system. In this connection, the second cistern is relatively large compared with the first cistern, although this is not necessarily so.

The first cistern has a first control means 6 for determining the extent of use of liquid therefrom. The first control means further controls the conveyance of liquid from the flexible container 1 to the first cistern, for example by varying the operation of the pump 2 and/or suitable valves between the container and the first cistern, according to the extent of use of liquid from the first cistern.

The second cistern 4 has a second control means 7 for determining whether the amount of water it holds falls below a minimum value. If this happens then the second control means instructs the pump 5 to convey water to the second cistern 4 from the first cistern 3.

Hence, in use of the apparatus, the flexible container carrying, for example, water is towed and moored to a location off-shore and connected to the first cistern by way of suitable piping. The first cistern supplies water to a second elevated cistern if the level of water in the second cistern drops below a certain critical level.

As water leaves the first cistern to the second cistern, its level will drop so that at a certain predetermined point, e.g. below 50% capacity, water will be puffed from the floating flexible container to the first cistern as controlled by the control means 6.

Since the flexible container of water is off-shore, no significant on-shore space is taken up and the size of the container is not limited by any on-shore restrictions. Indeed, for periods of extra demand, for example during the summer months, one or more additional containers may be coupled to the first cistern.

The naturally low temperature of the sea-water will keep the water stored within the container cool and thus slow down deterioration thereof. By using floating flexible vessels of the sort used for transporting fluent cargo through liquid, they can be readily towed to the required location and left there until substantially empty. The tug boat that towed the vessel to its location has thus a relatively quick turn around time as compared with a tanker in that no pumping out of liquid is required. The vessel can merely be uncoupled from the tug and suitably anchored, whereupon the tug can leave to complete a further task. The tug may thus operate to replace a laden vessel for an empty vessel so that its return journey is not wasted.

It will be understood that the embodiment illustrated shows an application of the invention in one form only for the purposes of illustration. In practice, the invention may be applied to many different configurations, the detailed embodiments being straightforward for those skilled in the art to implement.

For example, rather than the first cistern being connected to a second cistern, the first cistern may be a buffer cistern for covering change overs of flexible containers, the liquid being supplied direct therefrom to a mains supply pump.

Also, whilst the example described has been in relation to the supply of potable water, other liquids may be thus supplied, for example oil.

What is claimed is:

1. A method of supplying liquid comprising the steps of:

providing at a first location a cistern on land for liquid;

providing at a second location a floating flexible container of liquid;

incrementally conveying liquid from the container to the cistern according to a demand determined according to the use of liquid in the cistern.

2. A method according to claim 1, wherein the flexible container is a floating flexible vessel.

3. A method according to claim 1, further comprising the step of replacing a substantially empty container with a laden container.

4. A method according to claim 1, further comprising the step of pumping liquid from the flexible container to the cistern using a pumping means provided on a movable buoy.

5. A method according to claim 2, further comprising the step of replacing a substantially empty container with a laden container.

6. A method according to claim 2, further comprising the step of pumping liquid from the flexible container to the cistern using a pumping means provided on a movable buoy.

7. A method according to claim 3, further comprising the step of pumping liquid from the flexible container to the cistern using a pumping means provided on a movable buoy.

8. Apparatus for supplying liquid comprising:

an on land cistern for holding liquid and located at a first location;

a floating flexible container for holding liquid and located at a second location;

means for conveying liquid from the container to the cistern; and control means for determining the extent of use of liquid from the cistern and varying the quantity of liquid supplied to the cistern from the container in increments according to a demand determined by the extent of said use of liquid.

9. Apparatus according to claim 8, wherein the flexible container is a floating flexible vessel.

10. Apparatus according to claim 8, wherein the apparatus further comprises a pumping means for pumping liquid from the flexible container to the cistern, the pumping means being provided on a movable buoy.

11. Apparatus according to claim 8, wherein one or more additional flexible containers can be removably coupled with the flexible container to increase the capacity of the apparatus for periods of increased demand.

12. Apparatus according to claim 8, wherein the cistern is a first cistern that supplies a remotely located second cistern.

13. Apparatus according to claim 9, wherein the apparatus further comprises a pumping means for pumping liquid from the flexible container to the cistern, the pumping means being provided on a movable buoy.

14. Apparatus according to claim 9, wherein one or more additional flexible containers can be removably coupled with the flexible container to increase the capacity of the apparatus for periods of increased demand.

15. Apparatus according to claim 10, wherein one or more additional flexible containers can be removably coupled with the flexible container to increase the capacity of the apparatus for periods of increased demand.

16. Apparatus according to claim 9, wherein the cistern is a first cistern that supplies a remotely located second cistern.

17. Apparatus according to claim 10, wherein the cistern is a first cistern that supplies a remotely located second cistern.

18. Apparatus according to claim 11, wherein the cistern is a first cistern that supplies a remotely located second cistern.

* * * * *

UNITED STATES PATENT AND TRADEMARK OFFICE

CERTIFICATE OF CORRECTION

PATENT NO. : 6,161,561
DATED : December 19, 2000
INVENTOR(S) : Simon Michael Pratt et al.

It is certified that error appears in the above-identified patent and that said Letters Patent is hereby corrected as shown below:

Title page,
Item "[30] Foreign Application Priority Data", the application number should read -- 9620119.9 --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*